US006647851B2

(12) United States Patent
Donovan

(10) Patent No.: US 6,647,851 B2
(45) Date of Patent: Nov. 18, 2003

(54) METHOD FOR SUPPRESSING EJECTION OF FRAGMENTS AND SHRAPNEL DURING DESTRUCTION OF SHRAPNEL MUNITIONS

(75) Inventor: John Donovan, Danvers, IL (US)

(73) Assignee: DeMil International, Inc., Englewood, CO (US)

( * ) Notice: Subject to any disclaimer, the term of this patent is extended or adjusted under 35 U.S.C. 154(b) by 0 days.

(21) Appl. No.: 09/683,512

(22) Filed: Jan. 11, 2002

(65) Prior Publication Data

US 2003/0131722 A1 Jul. 17, 2003

(51) Int. Cl.[7] ..... F42B 33/00
(52) U.S. Cl. ..... 86/50; 588/202
(58) Field of Search ..... 86/49, 50; 110/237, 110/346; 72/54, 56, 706; 588/202, 203, 900; 29/421.2; 102/305, 315, 323, 324, 283, 292

(56) References Cited

U.S. PATENT DOCUMENTS

| | | | | | |
|---|---|---|---|---|---|
| 3,282,743 | A | * | 11/1966 | Holtzman | 148/703 |
| 3,629,021 | A | * | 12/1971 | Lyerly | 149/10 |
| 4,862,804 | A | * | 9/1989 | Chawla et al. | 102/307 |
| 5,024,159 | A | * | 6/1991 | Walley | 102/289 |
| 5,149,911 | A | * | 9/1992 | Ringbloom et al. | 102/302 |
| 5,248,055 | A | * | 9/1993 | Sanai et al. | 206/3 |
| 5,415,101 | A | * | 5/1995 | Brinkmann | 102/307 |
| 5,648,636 | A | * | 7/1997 | Simpson et al. | 102/355 |
| 5,884,569 | A | | 3/1999 | Donovan | |
| RE36,912 | E | | 10/2000 | Donovan | |
| 6,173,662 | B1 | | 1/2001 | Donovan | |
| 6,260,464 | B1 | * | 7/2001 | Gorrell et al. | 102/293 |
| 6,386,110 | B1 | * | 5/2002 | Landman et al. | 102/288 |

OTHER PUBLICATIONS

U.S. Environmental Protection Agency. "Contained Detonation System for Destroying UXO Containing Chemical Agents" [online], 2001 [retrieved on Sep. 9, 2002]. Retrieved from the Internet:<URL:http://www.hnd.usace.army.mil/oew/forums/UXO01/twing.pdf>.*

* cited by examiner

*Primary Examiner*—Charles T. Jordan
*Assistant Examiner*—Tara M. Golba
(74) *Attorney, Agent, or Firm*—Faegre and Benson LLP

(57) ABSTRACT

A method of suppressing shrapnel ejection inherent with fragmentary and shrapnel munition destruction. The present invention utilizes a method of imploding an initiating explosive onto the munition device whereby the munition device is exploded. The method has the counterbalancing effect between the explosion and the implosion, thus controlling and drastically decreasing the quantity, velocity, and kinetic energy of the resultant shrapnel ejection. An alternate embodiment of the present invention utilizes a combination of a cylindrical container with the wrapped munition device. The munition device to be destroyed is wrapped with flexible explosive material and placed into the cylindrical container and the resultant void space between the container walls and the munition is filled with pourable or fluid explosive material. Upon detonation of the flexible explosive material and fluid explosive material, an implosion and simultaneous chain reaction occurs whereby detonating the munition device itself. The resultant implosion substantially destroys the munition device and negates the need for any further manual dismantling.

37 Claims, 1 Drawing Sheet

METHOD FOR SUPPRESSING EJECTION OF FRAGMENTS AND SHRAPNEL DURING DESTRUCTION OF SHRAPNEL MUNITIONS

CROSS REFERENCE TO RELATED APPLICATIONS

This application is related to my application Ser. No. 09/457,976, filed Dec. 9, 1999, now issued as U.S. Pat. No. 6,354,181, which is a continuation-in-part of my application Ser. No. 09/191,045, filed on Nov. 12, 1998, now issued U.S. Pat. No. 6,173,662. Patent application Ser. No. 09/191,045 is also a continuation-in-part of my application Ser. No. 08/823,223 filed Mar. 24, 1997, now issued U.S. Pat. No. 5, 844,569. The latter application is a continuation-in-part of my parent application Ser. No. 08/578,200, filed Dec. 29, 1995, now issued U.S. Pat. No. 5,613,453 which has since been reissued with U.S. Pat. No. Re. 36,912 on Oct. 17, 2000. This patent application is commonly assigned as the patents and applications stated above and incorporates herein all of the same by reference.

BACKGROUND OF INVENTION

The present invention relates generally to the destruction of military grade weapons, particularly weapons with fragmentary and shrapnel ejection during detonation. More particularly, the present invention relates to a method of suppressing the velocity, quantity, and ultimate destructive force of shrapnel inherent in the destruction of fragmenting munition weapons, subsequently providing a safer environment during the destruction of such weapons by controlled detonation.

Militaries and governments around the world have amassed vast arsenals of weapons grade munitions, such as mortars, grenades, and the like. Many of these weapons were designed to disperse deadly shrapnel at high velocities upon detonation. This shrapnel dispersion can be achieved using numerous different methods, such as the munition casing itself being fragmented upon detonation, self-contained shrapnel pieces dispersed upon detonation, or many other methods. Upon detonation, this shrapnel is designed to be ejected at tremendous velocities and sometimes extremely high temperatures for the purpose of piercing and destroying armor, personnel, or anything else within the immediate vicinity.

However, as is inherent with any type of munition, shrapnel dispersing munitions have a fixed life span, thus becoming extremely unstable and unreliable past their design life. As such, and combined with the worldwide current demilitarization of fragmentary and shrapnel munitions, there is a need for an effective, safe and efficient manner to dispose of surplus and aged weaponry.

Presently, the main method of destruction of these weapons is to simply detonate them in a controlled environment. The majority of times this controlled environment is nothing more than a deserted location. However, inherent with this type of destruction technique, the fragmentary and shrapnel purposes of the munitions still achieve their design goals by ejecting dangerous shrapnel in all directions and at tremendous velocities, although in a somewhat more controlled situation. As such, this type of destruction is quite dangerous. The present invention overcomes this limitation by, for example, greatly reducing the kinetic energy and the quantity of ejection shrapnel.

Another common method of destruction is manual dismantling of the munition itself. As can be expected, this process is extremely dangerous for the personnel performing this function. The munition must be carefully disassembled, defused, and correctly disposed of. As such, this method has several limitations relating to the dangerous nature of dismantling the munition devices and properly disposing of the remaining products. The present invention overcomes this limitation by, for example, negating the need of dismantling the munition prior to destruction.

As described in my U.S. Pat. No. 5,884,569, issued on Mar. 23, 1999, I have previously created an improved method of destroying fragmentary and bomblet munitions. As disclosed in my '569 patent, I describe a method of first removing the individual bomblets from the cylindrical munition casing and placing them into an adjacently placed carrier tube, preferably constructed of an organic plastic material, such as polyvinyl chloride. As described in my '569 patent, manual intervention and manipulation of the individual bomblets is subsequently negated, thus providing a safer method of removal from the munition casing.

As I further disclose in my '569 patent, the carrier tube, now containing the bomblets, is then placed in a Fragmentation Containment Unit (FCU), shaped like a large, fortified bucket, which is subsequently placed within an explosion containment and suppression chamber, as disclosed in my U.S. Pat. No. 6,173,662, 5,884,569, and U.S. Pat. No. Re. 36,912. As such, by placing the carrier tube with the bomblets into the FCU, the FCU acts as a primary means to suppress the deadly shrapnel during the destructive detonation phase. However, to further enhance fragmentary suppression capabilities, upon placement of the FCU within the explosion containment and suppression chamber, I disclose suspending an interlocked steel blast mat of woven steel cable or linked chain directly above the FCU. As such, upon detonation, the plastic carrier tube is completely vaporized, the FCU absorbs a majority of the initial explosive shock and shrapnel, wherein the FCU directs any remaining shrapnel vertically, due to the shape and geometric configuration of the FCU, whereupon it is absorbed by the suspended steel blast mat and the surrounding explosion containment and suppression chamber.

However, a limitation of my '569 patent is that over numerous and repetitive destructive explosions, the kinetic energy released within fragmentation and shrapnel from the munitions during detonation is so intense, the interior surfaces of the explosion containment and suppression chamber begin to deteriorate and crater due to the continuous high-velocity bombardment of fragments and shrapnel attributable to fragmentary and shrapnel munition destruction.

The present invention overcomes the disadvantages and/or shortcomings of known prior methods of destroying fragmentary and shrapnel munitions and provides significant improvements thereover by, for example, proving a method of drastically reducing the fragmentary dispersion velocity and ejection quantity.

SUMMARY OF INVENTION

An object of the present invention is to provide a safe and effective method to destroy fragmentary and shrapnel munitions.

Yet another object of the present invention is to provide a method of suppressing and controlling shrapnel ejection and explosion kinetic energy while destroying fragmentary and shrapnel munitions.

And yet another object of the present invention is to substantially destroy fragmentary and shrapnel containing munitions while negating the need to manually dismantle the munitions devices prior to destruction.

Yet another object of the present invention is to provide a method to substantially destroy a fragmentary and shrapnel munition while negating the need to dispose of unspent hazardous and explosive materials inherent with conventional dismantling and destruction techniques.

The preferred embodiment of the present invention uses a flexible sheet of explosive material to substantially wrap the perimeter of the munition or shrapnel device that is to be destroyed. The flexible explosive material type and amount is dependent upon the device which is to be destroyed, along with other factors such as environment conditions, surroundings, potential hazardous contaminants, and the like. The munition device, substantially wrapped with flexible explosive material, is then placed on a support bed of explosion absorbing material, such as pea gravel. Destruction of the munition device occurs when the flexible sheet of explosive material is detonated, thereby imploding upon and simultaneously detonating the munition device. The implosion of the flexible explosive material creates a counter-force against the explosive forces of the munition device and subsequent shrapnel ejection. The present invention thus drastically decreases the overall explosive kinetic energy released from the munition device and the quantity and size of shrapnel discharge and velocity.

An alternate embodiment of the present invention utilizes a preferably cylindrical tube and a pourable explosive material, in conjunction with the flexible explosive material substantially wrapped around the munition device. The cylindrical tube is of a sufficient size and shape to provide a void space between the interior walls of the tube and exterior surface of the flexible explosive wrapped munition device when the munition device is placed within the interior of the tube. The explosive wrapped munition device and cylindrical tube are placed on a support bed of explosion absorbing material, such as pea gravel. The pourable explosive material, preferably granular or powdered, is then poured within the void space between the interior walls of the cylindrical tube and the exterior surfaces of the explosive sheet-wrapped munition device. Destruction of the munition device occurs by simultaneously detonating the pourable explosive material, the flexible sheet explosive wrap and the munition device. The implosion of the flexible sheet material creates a counter-force against the explosive forces of the munition device. The pourable explosive material also implodes upon the munition device and subsequently provides further countering effects upon the munition device explosion as well as vaporizes any remaining shrapnel and material.

By utilizing the present invention, the munition is completely destroyed by its own explosion, wherein there are no remaining hazardous materials, such as remaining fuel or unspent explosives. Furthermore, the balancing effect of the imploding pourable explosive material and flexible sheet explosive material provides enough counteractive force to effectively reduce the amount and velocity of expelled shrapnel from the munition device destruction.

BRIEF DESCRIPTION OF DRAWINGS

Preferred and alternate embodiments are herein described in detail with references to the drawings, where appropriate, wherein.

DETAILED DESCRIPTION

The present invention is a method to safely and effectively destroy fragmentary and shrapnel munition devices. The present invention preferably uses a flexible, wrapable sheet of explosive material to substantially wrap the munition device which is to be destroyed. The flexible sheet of explosive material subsequently implodes upon the munition device and has the effect of balancing the explosive forces of the munition device upon its detonation. As such, the amount, kinetic energy and velocity of resultant fragments and shrapnel from the munition device are greatly reduced, thus providing a much safer and efficient means of destroying fragmentary and shrapnel munition devices.

Figure 1:
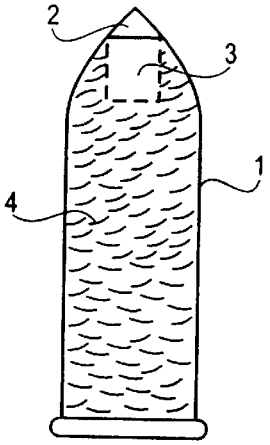
FIG. 1 is a sectional side elevation of a typical artillery munition, such as the United States Army 81 mm mortar projectile containing internal ejection shrapnel which is expelled during the munition detonation, which is typical of the type of munitions which may be safely disposed of by the present invention.

Referring to FIG. 1, the preferred embodiment of the present invention is utilized in conjunction with conventional artillery munition devices, such as a United States Army 81 mm mortar round, as depicted. However, artillery munitions of any type or size can be used within the present invention. A conventional mortar 1 generally contains either a proximity fuse or impact fuse device 2 located within its nose cone location. The fuse device 2 is typically connected to an internal detonation source 3. Generally within a conventional shrapnel mortar, a vast amount of shrapnel elements 4 surround explosive material and are contained within the munition device 1. The external shell of the mortar 1 is typically constructed of a material which facilitates easy and quick rupture upon detonation, such as thin-walled metals or plastics.

Upon detonation, the fuse 2 ignites the internal detonation device 3, which in turn detonates and ruptures the mortar 1 exterior shell through the resultant explosive force. With the exterior shell now gone, the explosive material expels the contained shrapnel 4 at extreme velocities and sometimes high temperatures, with devastating effect on anything within the immediate vicinity.

Figure 2:
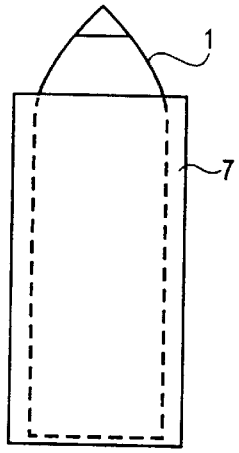
FIG. 2 is a side elevation view of a typical artillery munition substantially utilizing the preferred embodiment of the present invention.

Referring to FIG. 2, the present invention provides easy and safe destruction of munition devices 1 as described above the preferred embodiment of the present invention consists of a munition device 1 which is to be destroyed and flexible explosive material 7. The preferred embodiment of the present invention consists of substantially wrapping a flexible explosive material 7 around the periphery of the munition device 1 which is to be destroyed. The flexible explosive material 7 is preferably wrapped completely around the periphery of the munition device 1 in order to provide uniform implosion characteristics. Preferably, the flexible explosive material 7 is Composition C plastic explosive containing cyclotrimenetrinitramine (RDX) and/or pentaerythrite tetranitrate (PETN), such as C-4 or Semtex explosive. Alternately, other types of flexible plastic explosives can be utilized. Ultimately, the amount, type and consistency of the flexible explosive material 7 is dependent upon factors such as type of munition device 1 which is to be destroyed, environmental factors, potential hazardous contaminants, and the like.

Figure 3:
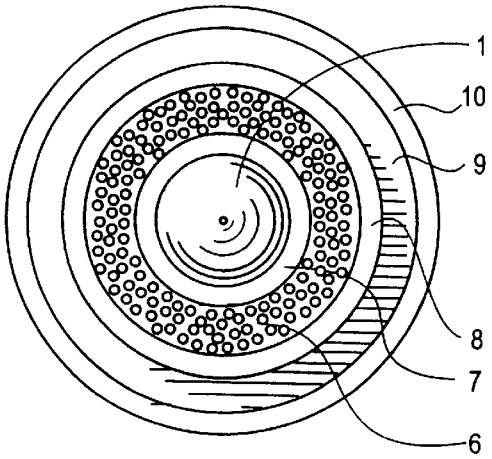
FIG. 3 is a plan view illustration of an alternate embodiment of the present invention with a typical artillery munition placed therein.
Figure 4:
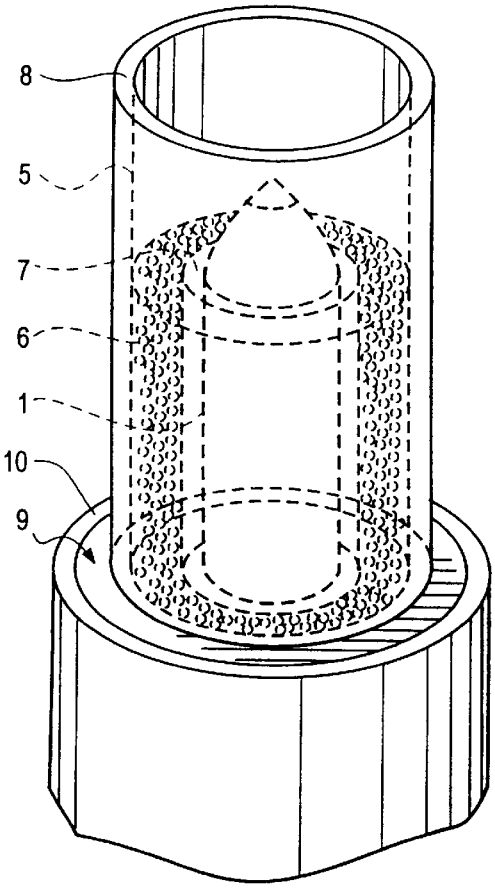
FIG. 4 is a isometric perspective illustration of an alternate embodiment of the present invention with a typical artillery munition placed therein.

The flexible explosive material 7 wrapped munition device 1 is then preferably placed on a structurally sound support. Referring to FIGS. 3 and 4, the preferred embodiment of the present invention utilizes explosive dampening material 9 contained within a containment means 10, as is depicted with the present invention's alternate embodiment. The explosive dampening material 9 is preferably gravel, pea gravel, or the like. Alternately, other forms of explosive dampening or absorption techniques may also be utilized. The containment means 10 is preferably a metal ring shaped device which contains the explosive dampening material 9 in a stable and secure manner. Alternately, other materials or geometric configurations can be effectively utilized as a containment means 10.

When munition destruction is initiated, the flexible explosive material 7 implodes upon and simultaneously detonates the munition device 1. Alternately, the munition device 1 and flexible explosive material 7 can be detonated simultaneously with an interconnected detonating means. The munition device 1 explodes wherein its explosive forces are counterbalanced by the implosive force of the flexible explosive material 7. The whole process occurs seemingly simultaneously and within micro-seconds. The granular absorbing material 9 absorbs a majority of the downward explosive forces, whereas the remaining explosive forces are multi-directionally released but with reduced kinetic energy due to the implosion/explosion balancing effect.

The balancing effect of the implosion has the effect of drastically reducing and subsequently controlling the explosive kinetic energy release and shrapnel ejection. It is with this method that the preferred embodiment of the present invention achieves its intended goals of completely destroying the munition device 1 while maintaining a safer atmosphere for munition destruction.

Figure 5:
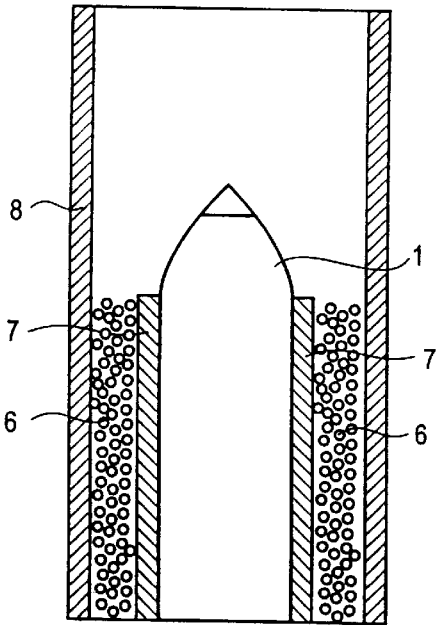
FIG. 5, is a sectional side elevation view of an alternate embodiment of the present invention with a typical artillery munition placed therein.

Referring to FIGS. 3, 4 and 5, an alternate embodiment of the present invention utilizes a munition device 1 substantially wrapped with flexible explosive material 7, as is described above within the preferred embodiment, in conjunction with a munition container 8. The munition container 8 is preferably a thin-walled cylindrical tube and preferably constructed of a material which is quickly and easily vaporized upon munition detonation, such as an organic, cardboard or cellulose. Alternately, other geometric configurations of the munition container 8 can be used. The munition device 1, after being substantially wrapped with flexible explosive material 7, is placed within the interior of the munitions container 8. The munitions container 8 is preferably designed with an interior diameter which is larger than the external diameter of the munition device 1 substantially wrapped with flexible explosive material 7. As such, when the munition device 1 wrapped with flexible explosive material 7 is placed within the munitions container 8, there is a void space between the interior wall of the munition container 8 and the external surface of the flexible explosive material 7. The munition device 1 with flexible explosive material 7 is preferably situated within the munitions container 8 to ensure a uniform and approximately concentric void space.

An alternate embodiment of the present invention places a pourable or fluid explosive material 6 within the void space. The pourable explosive material 6 is preferably placed substantially evenly and consistently within the void space, whereas there is not an accumulation of fluid explosive material 6 on one-side of the munition device 1, wrapped with flexible explosive material 7, when compared to the other side. The amount and type of fluid explosive material is dependent upon varying factors such as the type of munition being destroyed, the size of the munition, and environmental factors. The fluid explosive material 6 is preferably either a powdered or granular explosive matter, such as conventional Composite B plastic explosive containing mixtures of cyclotrimethylenetrinitramine (RDX) and trinitrotoluene (TNT) in the form of granular pebbles, such as is created by the extraction of explosive from other demilitarized weapons. Alternately, other fluid or pourable explosive materials can be effectively utilized.

The munition container 8, with the munition device 1 wrapped with flexible explosive material 7 and fluid explosive material 6 contained therein, is then preferably placed on a structurally sound support. The present invention utilizes explosive dampening material 9 contained within a containment means 10, as is depicted with the present invention's alternate embodiment. The explosive dampening material 9 is preferably gravel, pea gravel, or the like. Alternately, other forms of explosive dampening or absorption techniques may also be utilized. The containment means 10 is preferably a metal ring shaped device which contains the explosive dampening material 9 is a stable and secure manner. Alternately, other materials or geometric configurations can be effectively utilized as a containment means 10.

When munition destruction is initiated, the flexible explosive material 7, munition device 1 and fluid explosive material 6 are simultaneously detonated with a detonation means. Alternately, the flexible explosive material 7 and fluid explosive material 6 are simultaneously detonated with a detonation means. Both the flexible explosive material 7 and the fluid explosive material 6 implode upon the munition device 1. The munition device 1 explodes wherein its explosive forces are counterbalanced by the implosive forces of the flexible explosive material 7 and fluid explosive material 6. The munition device 1 and the munition container 8 are essentially vaporized. The whole process occurs seemingly simultaneously and within micro-seconds. The granular absorbing material 9 absorbs a majority of the downward explosive forces, whereas the remaining explosive forces are multi-directionally released but with reduced kinetic energy due to the implosion/explosion balancing effect.

The preferred and alternate embodiments of the present invention are intended to be utilized within an explosion containment and suppression chamber, such as is disclosed in my U.S. Pat. Nos., 6,173,662, 5,884,569 and U.S. Pat. No. Re. 36,912. Alternatively, the present invention can be utilized in an open environment, such as a deserted location, while still achieving its primary objectives of suppressing shrapnel ejection.

While preferred and alternate embodiments have been described herein, it is to be understood that these descriptions are only illustrative and are thus exemplifications of the present invention and shall not be construed as limiting. It is to be expected that others will contemplate differences, which, while different from the foregoing description, do not depart from the true spirit and scope of the present invention herein described and claimed.

What is claimed is:

1. A method of suppressing and counteracting the kinetic energy of shrapnel ejection during the destruction of a shrapnel munition, said shrapnel munition having a casing, said casing having an internal side, an external side and an external diameter, said shrapnel munition having munition explosive material within the inside of said casing, said method comprising the steps of:

wrapping the periphery of said shrapnel munition with an externally applied explosive material thereby creating a wrapped munition;

placing said wrapped munition onto a stable platform;

preparing said wrapped munition for detonation; and detonating said wrapped munition.

2. The method as claimed in claim 1, wherein said externally applied explosive material comprises a flexible sheet of explosive material.

3. The method as claimed in claim 2, wherein said flexible sheet of explosive material comprises a Composition C plastic explosive.

4. The method as claimed in claim 3, wherein said Composition C plastic explosive comprises C-4 plastic explosive.

5. The method as claimed in claim 3, wherein said Composition C plastic explosive comprises Semtex plastic explosive.

6. The method as claimed in claim 1, wherein said stable platform comprises an explosion absorbing material, said explosion absorbing material being held in place by a ring structure.

7. The method as claimed in claim 6, wherein said explosion absorbing material comprises granular fill material.

8. The method as claimed in claim 1, wherein the step of detonating said wrapped munition comprises simultaneously detonating said shrapnel munition and said externally applied explosive material.

9. The method as claimed in claim 1, wherein the step of detonating said wrapped munition comprises detonating said externally applied explosive material.

10. The method as claimed in claim 1, wherein the step of preparing said wrapped munition for detonation comprises the steps of:

creating a shrapnel munition container, said shrapnel munition container having an interior surface, said interior surface defining an interior portion being of a sufficient size to receive said wrapped munition;

placing said wrapped munition into said interior portion of said shrapnel munition container thereby creating a void space between said interior surface of said shrapnel munition container and said wrapped munition;

placing fluid explosive material into said void space.

11. The method as claimed in claim 10, wherein said shrapnel munition container has a cylindrical shape.

12. The method as claimed in claim 10, wherein said shrapnel munition container is constructed of an organic material.

13. The method as claimed in claim 10, wherein said shrapnel munition container is constructed of cellulose.

14. The method as claimed in claim 10, wherein said fluid explosive material comprises powdered explosive material.

15. The method as claimed in claim 14, wherein said fluid explosive material comprises granular explosive material.

16. The method as claimed in claim 14, wherein said fluid explosive material comprises a Composition B plastic explosive.

17. The method as claimed in claim 10, wherein the step of detonating said wrapped munition comprises simultaneously detonating said shrapnel munition, said externally applied explosive material and said fluid explosive material.

18. The method as claimed in claim 10, wherein the step of detonating said wrapped munition comprises simultaneously detonating said externally applied explosive material and said fluid explosive material.

19. The method as claimed in claim 1 utilized in connection with an explosion containment and suppression chamber.

20. A method comprising:

wrapping a substantial portion of the periphery of the shrapnel munition that is to be destroyed with a malleable explosive material; and destroying the shrapnel munition while reducing the kinetic energy and the quantity of ejection shrapnel from the shrapnel munition by causing the malleable explosive material to implode upon the shrapnel munition.

21. The method of claim 20, wherein said malleable explosive material comprises a flexible sheet of plastic explosive material.

22. The method of claim 21, wherein said flexible sheet of plastic explosive material comprises C-4 plastic explosive.

23. The method of claim 21, wherein said flexible sheet of plastic explosive material comprises Semtex plastic explosive.

24. The method of claim 21, further comprising the steps of:

placing the wrapped shrapnel munition into a shrapnel munition container;

placing a pourable explosive material in a space between an interior surface of the shrapnel munition container and the wrapped shrapnel munition.

25. The method of claim 24, wherein the pourable explosive material comprises powdered explosive material.

26. The method of claim 24, wherein the pourable explosive material comprises granular explosive material.

27. The method of claim 24, wherein the pourable explosive material comprises a Composition B plastic explosive.

28. The method of claim 20, wherein said destroying the shrapnel munition further comprises substantially simultaneously detonating the malleable explosive material and the shrapnel munition.

29. The method of claim 24, wherein said destroying the shrapnel munition further comprises substantially simultaneously detonating the malleable explosive material, the shrapnel munition, and the pourable explosive material.

30. The method of claim 20, wherein substantially uniform implosion characteristics are provided by wrapping the malleable explosive material completely around the periphery of the shrapnel munition.

31. The method of claim 20 utilized in connection with an explosion containment and suppression chamber.

32. A method of destroying a shrapnel munition, said method comprising the steps of:

creating a wrapped munition by wrapping a substantial portion of the periphery of the shrapnel munition that is to be destroyed with a flexible sheet of Composition C plastic explosive material;

preparing the wrapped munition for detonation; and destroying the wrapped munition while reducing the kinetic energy and the quantity of ejection shrapnel from the shrapnel munition by causing the flexible sheet of Composition C plastic explosive material to implode upon the shrapnel munition.

33. The method of claim 32, wherein said preparing the wrapped munition for detonation comprises:

placing the wrapped munition into an interior portion of a shrapnel munition container thereby creating a void space between an interior surface of said shrapnel munition container and the wrapped munition;

substantially evenly and consistently placing a pourable explosive material into the void space; and placing the shrapnel munition container onto a stable platform of explosion absorbing material.

34. The method of claim 33, wherein said destroying the wrapped munition comprises substantially simultaneously detonating the flexible sheet of Composition C plastic explosive material and the pourable explosive material.

35. The method of claim 32, wherein said destroying the wrapped munition comprises substantially simultaneously detonating the flexible sheet of Composition C plastic explosive material and the shrapnel munition.

36. The method of claim 32 utilized in connection with an explosion containment and suppression chamber.

37. A method of destroying a shrapnel munition, said method comprising:

step for creating a wrapped munition using a flexible explosive material;

a step for preparing the wrapped munition for detonation; and a step for destroying the wrapped munition while reducing the kinetic energy and the quantity of ejection shrapnel from the shrapnel munition.

* * * * *